US009482203B2

(12) United States Patent
Hanashi

(10) Patent No.: US 9,482,203 B2
(45) Date of Patent: Nov. 1, 2016

(54) SPARK PLUG FOR INTERNAL COMBUSTION ENGINES AND MOUNTING STRUCTURE FOR THE SPARK PLUG

(71) Applicant: DENSO CORPORATION, Kariya, Aichi-pref (JP)

(72) Inventor: Ken Hanashi, Obu (JP)

(73) Assignee: DENSO CORPORATION, Kariya (JP)

( * ) Notice: Subject to any disclaimer, the term of this patent is extended or adjusted under 35 U.S.C. 154(b) by 214 days.

(21) Appl. No.: 14/355,967

(22) PCT Filed: Oct. 31, 2012

(86) PCT No.: PCT/JP2012/078181
§ 371 (c)(1),
(2) Date: May 2, 2014

(87) PCT Pub. No.: WO2013/065743
PCT Pub. Date: May 10, 2013

(65) Prior Publication Data

US 2014/0299087 A1 Oct. 9, 2014

(30) Foreign Application Priority Data

Nov. 2, 2011 (JP) ..... 2011-241456

(51) Int. Cl.
*H01T 13/20* (2006.01)
*F02P 15/00* (2006.01)
(Continued)

(52) U.S. Cl.
CPC ..... *F02P 15/00* (2013.01); *F02P 13/00* (2013.01); *H01T 13/14* (2013.01); *H01T 13/32* (2013.01); *H01T 13/467* (2013.01)

(58) Field of Classification Search
CPC ..... F02P 15/00; F02P 13/00; H01T 13/14; H01T 13/467; H01T 13/32
USPC .... 313/141–143; 123/146.5, 169 R, 169 EL, 123/169 EA
See application file for complete search history.

(56) References Cited

U.S. PATENT DOCUMENTS 5,502,352 A * 3/1996 Katoh ..... H01T 13/467 123/169 EL
5,581,145 A * 12/1996 Kato ..... H01T 13/467 313/123

(Continued)

FOREIGN PATENT DOCUMENTS

EP 1544969 A1 * 6/2005
EP 1544970 A1 * 6/2005

(Continued)

OTHER PUBLICATIONS

International Preliminary Report on Patentability (11 pages) for PCT/JP2012/078181 mailed May 15, 2014.

(Continued)

*Primary Examiner* — Joseph Dallo
(74) *Attorney, Agent, or Firm* — Nixon & Vanderhye P.C.

(57) ABSTRACT

A spark plug is provided, which includes a housing, an insulation porcelain, a center electrode, a main ground electrode, a first sub ground electrode and a second sub ground electrode. The first and second sub ground electrode are arranged being opposed to each other. Requirements of Hs1<Hc+Gm, Gm<Gs1+Gg, Gm<Gs2+Gg, Hs2≥Hs1 and Hc<Hs2 are satisfied, where Hc is the length of projection of the center electrode, Gm is the size of the main gap, Hs1 is the length of projection of the first sub ground electrode, Hs2 is the length of projection of the second sub ground electrode, Gs1 is the length of the first sub gap in the radial direction of the plug, Gs2 is the length of the second sub gap in the radial direction of the plug, and Gg is the distance between an outer peripheral edge portion and an inner peripheral edge portion of a porcelain tip portion in the radial direction of the plug.

5 Claims, 14 Drawing Sheets

(51) Int. Cl.

| | |
|---|---|
| ***F02P 13/00*** | (2006.01) |
| ***H01T 13/32*** | (2006.01) |
| ***H01T 13/46*** | (2006.01) |
| ***H01T 13/14*** | (2006.01) |

(56) References Cited

U.S. PATENT DOCUMENTS

| | | | | |
|---|---|---|---|---|
| 5,929,556 | A | 7/1999 | Matsubara et al. | |
| 6,229,253 | B1 | 5/2001 | Iwata et al. | |
| 8,036,808 | B2 * | 10/2011 | Mori | F02P 9/00 123/169 EA |
| 2002/0109447 | A1 * | 8/2002 | Hanashi | H01T 13/39 313/123 |
| 2003/0155849 | A1 | 8/2003 | Hori | |
| 2005/0052107 | A1 * | 3/2005 | Klett | H01T 13/20 313/143 |
| 2005/0194877 | A1 * | 9/2005 | Horn | H01T 13/467 313/141 |
| 2005/0264153 | A1 * | 12/2005 | Hanashi | H01T 13/32 313/141 |
| 2006/0028107 | A1 * | 2/2006 | Hori | H01T 13/467 313/141 |
| 2008/0284304 | A1 * | 11/2008 | Watanabe | H01T 13/32 313/141 |
| 2009/0309474 | A1 * | 12/2009 | Nunome | H01T 13/20 313/141 |
| 2010/0320894 | A1 * | 12/2010 | Hartmann | H01T 13/467 313/142 |

FOREIGN PATENT DOCUMENTS

| | | |
|---|---|---|
| JP | 11-324878 | 11/1999 |
| JP | 11-351115 | 12/1999 |
| JP | 2000-68032 | 3/2000 |
| JP | 3140006 | 12/2000 |
| JP | 2001068251 A * | 3/2001 |
| JP | 3272615 | 1/2002 |
| JP | 2002-231414 | 8/2002 |
| JP | 2003-317896 | 11/2003 |
| JP | 2006-73205 | 3/2006 |
| JP | 2008-171646 | 7/2008 |
| JP | 2010-73313 | 4/2010 |

OTHER PUBLICATIONS

Office Action (2 pages) dated Jul. 21, 2015, issued in corresponding Japanese Application No. 2011-241456 and English translation (2 pages).

International Search Report for PCT/JP2012/078181 mailed Feb. 5, 2013.

Microfilm of the Specification and Drawings Annexed to the Request of Japanese Utility Model Application No. 30920/1978, Sep. 19, 1979.

* cited by examiner

SPARK PLUG FOR INTERNAL COMBUSTION ENGINES AND MOUNTING STRUCTURE FOR THE SPARK PLUG

CROSS-REFERENCE TO RELATED APPLICATION

This application is the U.S. national phase of International Application No. PCT/JP2012/078181 filed 31 Oct. 2012 which designated the U.S. and claims priority to JP Application No. 2011-241456 filed Nov. 2, 2011, the entire contents of each of which are hereby incorporated by reference.

TECHNICAL FIELD

The present invention relates to a spark plug for an internal combustion engine and a mounting structure for the spark plug, the spark plug being used for passenger cars, automatic two-wheeled vehicles, cogeneration systems, gas pressure pumps or the like.

BACKGROUND TECHNIQUE

FIG. 1 shows a conventionally used spark plug 9 for an internal combustion engine. For example, the spark plug 9 is used as a means for igniting an air-fuel mixture introduced into a combustion chamber of an internal combustion engine such as of a passenger car.

The spark plug 9 includes a center electrode 94 and a ground electrode 95. The ground electrode 95 has an end fixed to a housing 92, while being crooked to bring the other end to a position facing the center electrode 94, to form a spark discharge gap 911 in relation to the center electrode 94. The ground electrode 95 is provided with a projection portion 96 which is projected toward the spark discharge gap 911 (see Patent Document 1). Thus, as shown in FIG. 2 by (A) and (B), discharge is caused in the spark discharge gap 911 to ignite an air-fuel mixture by the discharge. In the figure, a reference E indicates a discharge spark formed by the discharge, a reference F indicates a flow of the air-fuel mixture, and reference I indicates a flame.

Recently, various lean-burn internal combustion engines are developed to enhance fuel efficiency. In lean burn, the flow speed of the air-fuel mixture in the combustion chamber is designed to be high in order to retain ignitability to the air-fuel mixture. On the other hand, in the spark discharge gap, ignition performance depends, to a large extent, on the positional relationship of the ground electrode with respect to the direction of the gas flow in the combustion chamber. For this reason, the position of the ground electrode is adjusted relative to the direction of the flow of the air-fuel mixture. In this regard, a technique is suggested with which a spark plug is mounted to an internal combustion engine so that the ground electrode will not be located upstream or downstream in the gas flow (see Patent Document 2).

In order to achieve good combustion, some lean-burn internal combustion engines mentioned above use a so-called in-cylinder direct injection system in which an air-fuel mixture is directly injected into the combustion chamber. Such an in-cylinder direct injection system ensures ignitability by enriching the air-fuel mixture near the spark discharge gap. Therefore, the spark plug is fouled by carbon which is induced by incomplete combustion, i.e. carbon adheres to a porcelain tip portion of the spark plug, creating an electrically conductive state. This raises a problem that discharge is not appropriately obtained in relation to the ground electrode. As a measure against such a problem, a spark plug 90 as shown in FIG. 3 is suggested. The spark plug 90 is configured by a main ground electrode 951 that forms a main gap 912 and sub ground electrodes 952 that form a sub gap 913 to thereby enhance resistance to carbon fouling (see Patent Documents 3 and 4).

PRIOR ART DOCUMENTS

Patent Documents

[Patent Document 1] JP-A-2003-317896
[Patent Document 2] JP-A-H11-324878
[Patent Document 3] JP-B-3272615
[Patent Document 4] JP-B-3140006

SUMMARY OF THE INVENTION

Problems to be Solved by the Invention

However, in the lean burn mentioned above, the flow speed of the air-fuel mixture is high in the combustion chamber. Therefore, for example, when the spark plug 9 of Patent Document 1 mentioned above is used, the discharge spark E is easily expanded and cut off, as shown in FIG. 2 by (C), according to the higher flow speed of the air-fuel mixture before the air-fuel mixture is heated by the discharge spark E in the spark discharge gap 911. When the discharge spark E is extinguished, a phenomenon of causing a discharge for the second time (hereinafter this is referred to as re-discharge) occurs downstream in the flow F between an edge portion of a tip portion (projection portion 941) of the center electrode 94 and an edge portion of the projection portion 96 of the ground electrode 95, and this is repeated. Specifically, the discharge spark E is constantly drifted in a constant direction, i.e. downstream, by the flow F to repeatedly cause re-discharges between the edge portion of the tip portion (projection portion 941) of the center electrode 94 and the edge portion of the projection 96. Thus, these portions are likely to be disproportionately worn out (hereinafter this is referred to as disproportionate wear). As a result, the life of the spark plug 9 is problematically shortened.

When the spark plug 90 of Patent Document 3 or 4 mentioned above as shown in FIG. 3 is used, the main ground electrode 951 is required to be ensured not to be located upstream or downstream in the flow F of the air-fuel mixture, in order that the flow F directed to the main gap 912 will not be blocked. However, when the main ground electrode 951 is arranged at such a position, the sub ground electrodes 952 will be positioned upstream and downstream in the flow F, as shown in FIG. 4, allowing the sub ground electrodes 952 to block the flow F. Accordingly, in the use of the spark plug 90, the main ground electrode 951 or the sub ground electrodes 952 will block the flow F in whatever posture the spark plug 90 may be mounted to the internal combustion engine. Thus, ignitability may be impaired.

It is thus desired to provide a spark plug for an internal combustion engine and a mounting structure for the spark plug, with which ignitability and life of the spark plug are enhanced, while resistance to carbon fouling is retained.

Means for Solving the Problems

An aspect of the present disclosure lies in a spark plug for an internal combustion engine including: a cylindrical housing; a cylindrical insulation porcelain held inside the housing, with a porcelain tip portion projecting from the housing; a center electrode held inside the insulation porcelain, with a tip portion being projected; a main ground electrode connected to the housing and having an opposing portion that faces the center electrode in an axial direction of the spark plug to form a main gap in relation to the center electrode; a first sub ground electrode connected to the housing and forming a first sub gap in relation to an outer peripheral edge portion in the porcelain tip portion; and a second sub ground electrode connected to the housing and forming a second sub gap in relation to the outer peripheral edge portion in the porcelain tip portion, the spark plug being characterized in that: the first sub ground electrode and the second sub ground electrode are arranged face to face sandwiching the opposing portion of the main ground electrode as viewed in the axial direction of plug; and the following requirements are satisfied:

$Hs\,1<Hc+Gm$, $Gm<Gs1+Gg$, $Gm<Gs2+Gg$, $Hs2\geq Hs1$ and $Hc<Hs2$ where Hc is a length of projection of the center electrode from the housing, Gm is a size of the main gap, Hsl is a length of projection of the first sub ground electrode from a tip of the housing, Hs2 is a length of projection of the second sub ground electrode from a tip of the housing, Gs1 is a length of the first sub gap in a radial direction of plug, Gs2 is a length of the second sub gap in a radial direction of plug and Gg is a distance between the outer peripheral edge portion and an inner peripheral edge portion of the porcelain tip portion in a radial direction of plug.

Another aspect lies in a mounting structure for mounting the above spark plug in an internal combustion engine, the mounting structure being characterized in that the first sub ground electrode arranged in a combustion chamber of the engine is located upstream of the second sub ground electrode with respect to a flow of an air-fuel mixture supplied to the combustion chamber.

Advantageous Effects

As viewed in the axial direction of the plug, the spark plug is arranged such that the first sub ground electrode and the second sub ground electrode are located face to face sandwiching the opposing portion of the main ground electrode. Thus, the spark plug can be mounted to the internal combustion engine such that the main ground electrode is ensured not to be located upstream or downstream in the flow of the air-fuel mixture, with the first sub ground electrode being located upstream in the flow and the second sub ground electrode being located downstream in the flow.

The length of projection Hs1 of the first sub ground electrode from the tip of the housing satisfies Hs1<Hc+Gm. Thus, in the above arrangement condition, the flow directed to the main gap is prevented from being blocked by the first sub ground electrode located upstream, thereby allowing the flow to enter the main gap. As a result, the air-fuel mixture comes to be easily ignited in the main gap. At the same time, ignitability of the spark plug is enhanced, owing to the ease of flame growth.

Further, when carbon fouling occurs in the spark plug, i.e. when carbon fouling occurs in the porcelain tip portion of the spark plug, creating an electrically conductive state, and discharge can no longer be appropriately obtained in relation to the main ground electrode, discharge can be caused in the first sub gap. A discharge spark in this instance will burn off and eliminate the carbon. Thus, the portion from which the carbon has been eliminated is restored from the electrically conductive state to an insulated state, thereby retaining insulation properties of the porcelain tip portion. Therefore, appropriate discharge is caused between the center electrode and the main ground electrode and thus a discharge spark is obtained. In this way, resistance to carbon fouling is retained and the life of the spark plug is enhanced.

Further, the spark plug satisfies Gm<Gs1+Gg and Gm<Gs2+Gg. Thus, in the spark plug prior to the occurrence of carbon fouling, a discharge spark is prevented from being generated between the center electrode and the first sub ground electrode or between the center electrode and the second sub ground electrode. Thus, a discharge spark is obtained normally in the main gap. As a result, the air-fuel mixture is easily ignited in the main gap and thus flame is easily grown. Thus, ignitability of the spark plug is enhanced.

Further, spark plug satisfies Hs2≥Hs1 and Hc<Hs2, where Hs1 is the length of projection of the first sub ground electrode from the tip of the housing, Hs2 is the length of projection of the second sub ground electrode from the tip of the housing, and Hc is the length of projection of the center electrode from the housing. Thus, when a discharge spark generated in the main gap is expanded to a large extent by the gas flow in the above arrangement condition, the discharge spark is received by the second sub ground electrode. In other words, since the discharge spark is prevented from being expanded to a large extent and from being cut off, the discharge spark is sustained between the center electrode and the second sub ground electrode. Therefore, repetition of discharge cutoff and re-discharge is suppressed. As a result, the center electrode and the main ground electrode are suppressed from being worn out to thereby enhance the life of the spark plug. In addition, since the discharge spark is sustained as mentioned above, an ignition opportunity (i.e., an opportunity for the ignition which leads to the ignition) is well ensured and thus ignitability of the spark plug is enhanced.

As described above, according to the foregoing aspects, a spark plug for an internal combustion engine and a mounting structure for the spark plug are provided, with which ignitability and life of the spark plug are enhanced, while resistance to carbon fouling is retained.

MODES FOR IMPLEMENTING THE INVENTION

Hereinafter are described several embodiments of a spark plug for an internal combustion engine and a mounting structure for the spark plug, according to the present invention.

The spark plug for an internal combustion engine may be used as an igniting means for an internal combustion engine such as of passenger cars, automatic two-wheeled vehicles, cogeneration, or gas pressure pumps.

In the description in the present specification, a side from which the spark plug is inserted into the combustion chamber of an internal combustion engine is referred to as a tip side, and a side opposite to the side is referred to as a base side.

(First Embodiment)

Referring to FIGS. 5 to 10, a spark plug of an embodiment is described.

Figure 5:
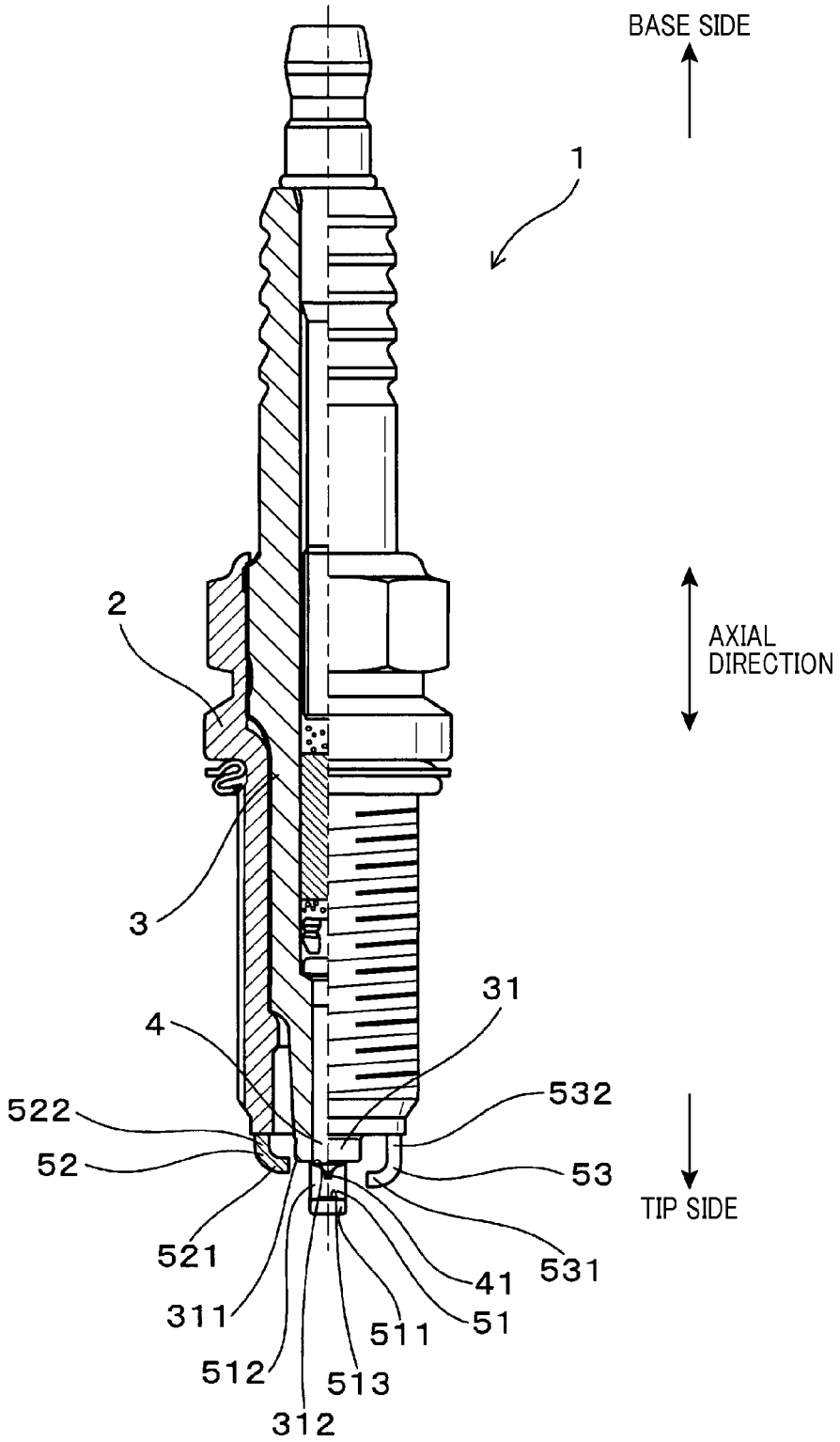
FIG. 5 is an explanatory view illustrating a partial cross section of a spark plug, according to a first embodiment.

As shown in FIG. 5, a spark plug 1 of the present embodiment includes: a cylindrical housing 2; a cylindrical insulation porcelain 3 held inside the housing 2 such that a porcelain tip portion 31 is projected from the housing 2; a center electrode 4 held inside the insulation porcelain 3, with a tip portion thereof being projected; and a main ground electrode 51, a first sub ground electrode 52 and a second sub ground electrode 53, which are connected to the housing 2.

Figure 6:
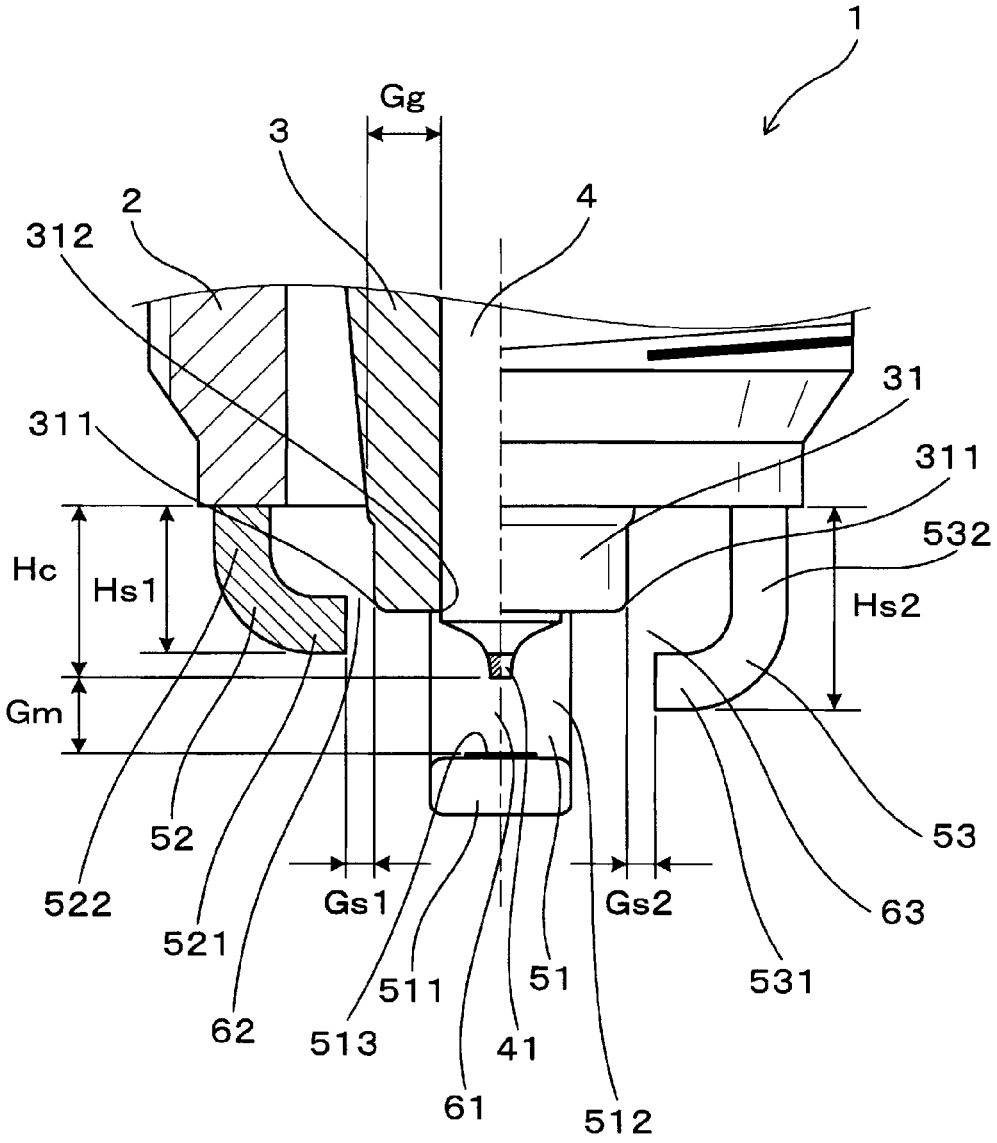
FIG. 6 is an explanatory view illustrating a partial cross section of a tip portion of the spark plug according to the first embodiment.

As shown in FIG. 6, the main ground electrode 51 has an opposing portion 511 that faces the center electrode 4 in the axial direction of the plug (longitudinal direction of the spark plug 1: see FIG. 5) to form a main gap 61 in relation to the center electrode 4.

The first sub ground electrode 52 forms a first sub gap 62 in relation to an outer peripheral edge portion 311 in the porcelain tip portion 31.

The second sub ground electrode 53 forms a second sub gap 63 in relation to an outer peripheral edge portion 311 in the porcelain tip portion 31.

Figure 7:
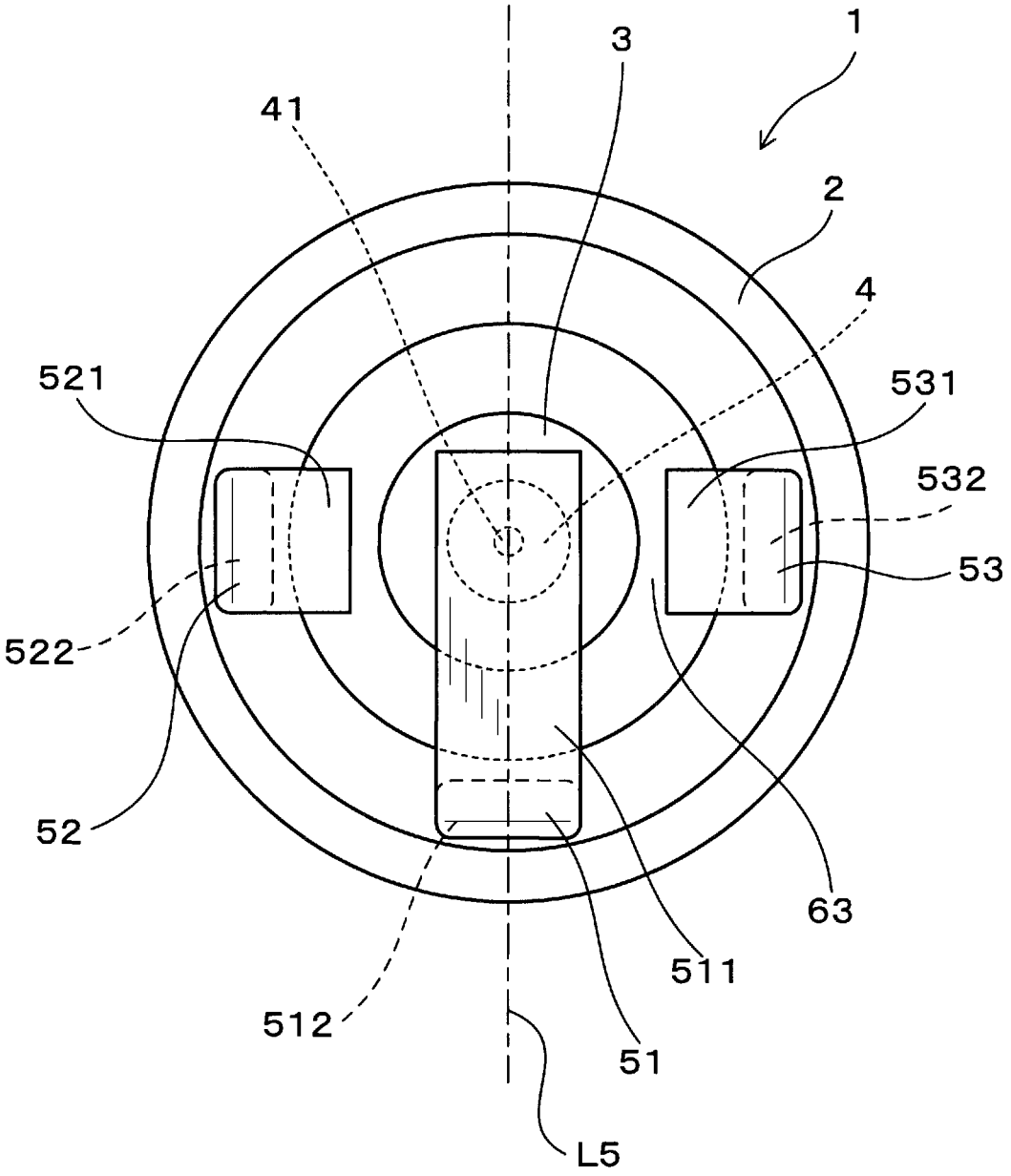
FIG. 7 is a bottom view illustrating the spark plug according to the first embodiment.

As shown in FIG. 7, as viewed in the axial direction of the plug, the first sub ground electrode 52 and the second sub ground electrode 53 are arranged face to face, sandwiching the opposing portion 511 of the main ground electrode 51.

Further, the spark plug 1 is formed such that the following requirements are satisfied. Specifically, as shown in FIG. 6, the spark plug 1 satisfies the following requirements:

$$Hs1<Hc+Gm,$$

$$Gm<Gs1+Gg,$$

$$Gm<Gs2+G2,$$

$$Hs2\geq Hs1, \text{ and}$$

$$Hc<Hs2,$$

where Hc is the length of projection of the center electrode 4 from the housing 2, Gm is the size of the main gap 61, Hs1 is the length of projection of the first sub ground electrode 52 from a tip of the housing 2, Hs2 is the length of projection of the second sub ground electrode 53 from a tip of the housing 2, Gs1 is the length of the first sub gap 62 in the radial direction of the plug, Gs2 is the length of the second sub gap 63 in the radial direction of the plug, and Gg is the distance between the outer peripheral edge portion 311 and an inner peripheral edge portion 312 of the porcelain tip portion 31 in the radial direction of the plug.

Further, the spark plug 1 satisfies a relation Gs1<Gs2.

In the spark plug 1 of the present embodiment, the housing 2 has a diameter of 10 mm and a thickness of 1.4 mm at a tip portion of the housing 2.

As shown in FIGS. 5 to 7, the main ground electrode 51 includes: a vertical portion 512 vertically provided on the tip side, with its one end being fixed to the tip portion of the housing 2; and the opposing portion 511 provided, being crooked, from the other end of the vertical portion 512 so as to face the center electrode 4 in the axial direction of the plug.

In the present embodiment, the opposing portion 511 has a surface opposed to the center electrode 4, in which a projection portion 513 (omitted in FIG. 7) is arranged. The projection portion 513 of the present embodiment is arranged being embedded in the opposing portion 511, but this shall not impose a limitation.

The center electrode 4 of the present embodiment has a tip portion that configures a projection portion 41 in substantially a pillar shape.

The projection portion 513 and the projection portion 41 are each configured by a noble metal chip. For example, the projection portion 513 arranged in the opposing portion 511 of the main ground electrode 51 is configured by a platinum alloy.

For example, the projection portion 41 arranged in the tip portion of the center electrode 4 is configured by an iridium alloy. However, configuration shall not be limited to these. For example, the projection portion 41 may be configured by a high-melting member, such as a rhodium alloy or a tungsten alloy.

In the present embodiment, the noble metal chip is bonded by welding to the opposing portion 511 of the main ground electrode 51 so that the noble metal chip configures the projection portion 513.

The first sub ground electrode 52 and the second sub ground electrode 53 have respective ends fixed to the tip portion of the housing 2, and also have respective vertical portions 522 and 532 vertically provided on the tip side, and respective opposing portions 521 and 531 crooked from respective ends of the vertical portions 522 and 532 to face the center electrode 4 in a direction perpendicular to the axial direction of the plug.

A base material that is a nickel alloy is used for the housing 2, the main ground electrode 51 (portions other than the projection portion 513), the first sub ground electrode 52 and the second sub ground electrode 53.

The spark plug 1 of the present embodiment is used for an internal combustion engine for a vehicle, such as a passenger car.

Figure 8:
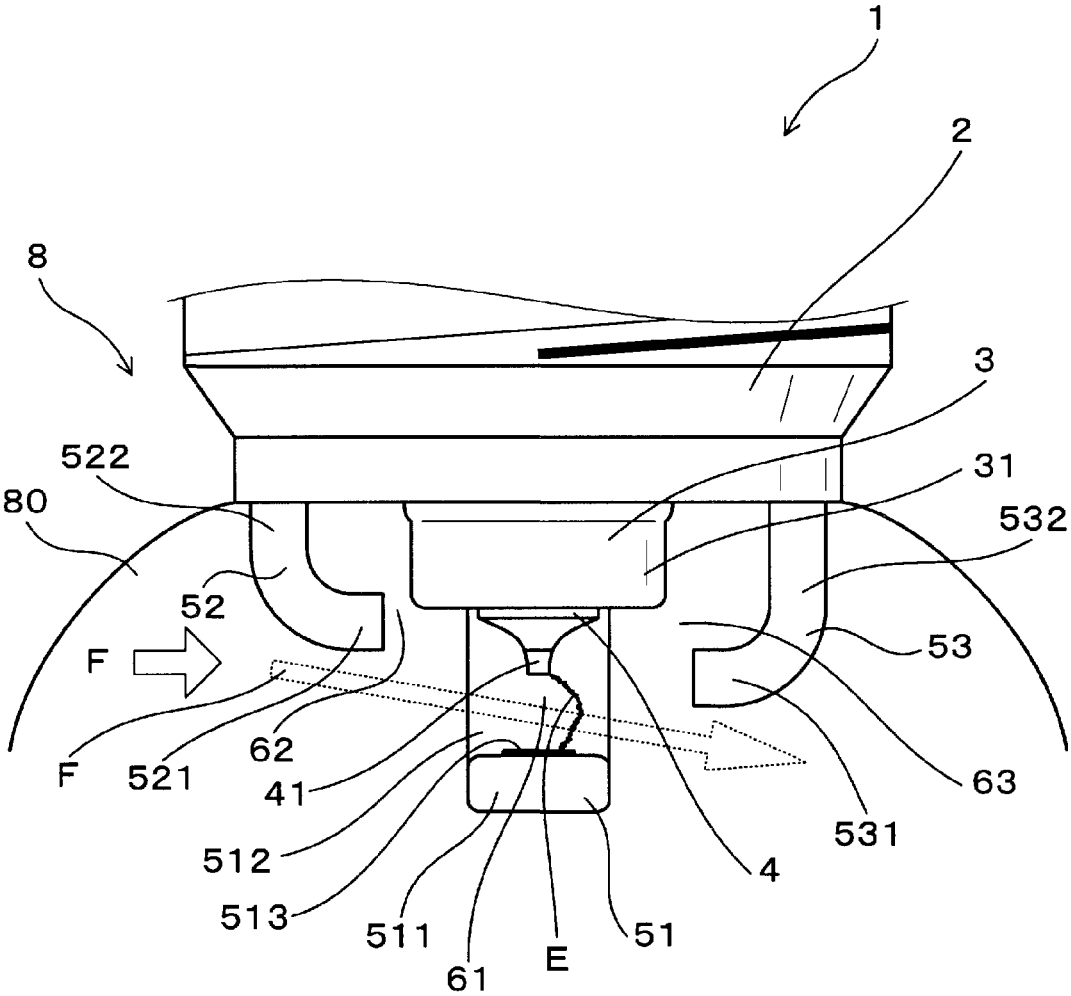
FIG. 8 is an explanatory view illustrating a state where the spark plug according to the first embodiment is mounted into a combustion chamber.

Referring to FIG. 8, hereinafter is described a mounting structure with which the spark plug 1 of the present embodiment is mounted to an internal combustion engine 8.

For example, in mounting the spark plug 1 to the internal combustion engine 8, a well-known technique (e.g., JP-A-H11-324878 or JP-A-H11-351115) is used. As shown in FIG. 8, in mounting the spark plug 1 to the internal combustion engine 8 using the technique, the position of the main ground electrode 51 is adjusted with respect to the direction of the flow F of the air-fuel mixture in a combustion chamber 80.

Specifically, as shown in FIG. 8, the spark plug 1 is mounted to the internal combustion engine 8 by conducting an adjustment such that an extending direction of the opposing portion 511 (broken line L5 indicated in FIG. 7) of the main ground electrode 51 will be perpendicular to the direction of the flow F. In other words, the spark plug 1 is mounted to the internal combustion engine 8 so that the vertical portion 512 of the main ground electrode 51 will not block the flow F.

Further, as shown in FIG. 8, the first sub ground electrode 52 is arranged in the combustion chamber 80 so as to be located upstream of the second sub ground electrode 53 with respect to the flow F of the air-fuel mixture supplied to the combustion chamber 80. This arrangement may also be realized by using the well-known technique (e.g., JP-A-H11-324878 or JP-A-H11-351115).

Figure 9:
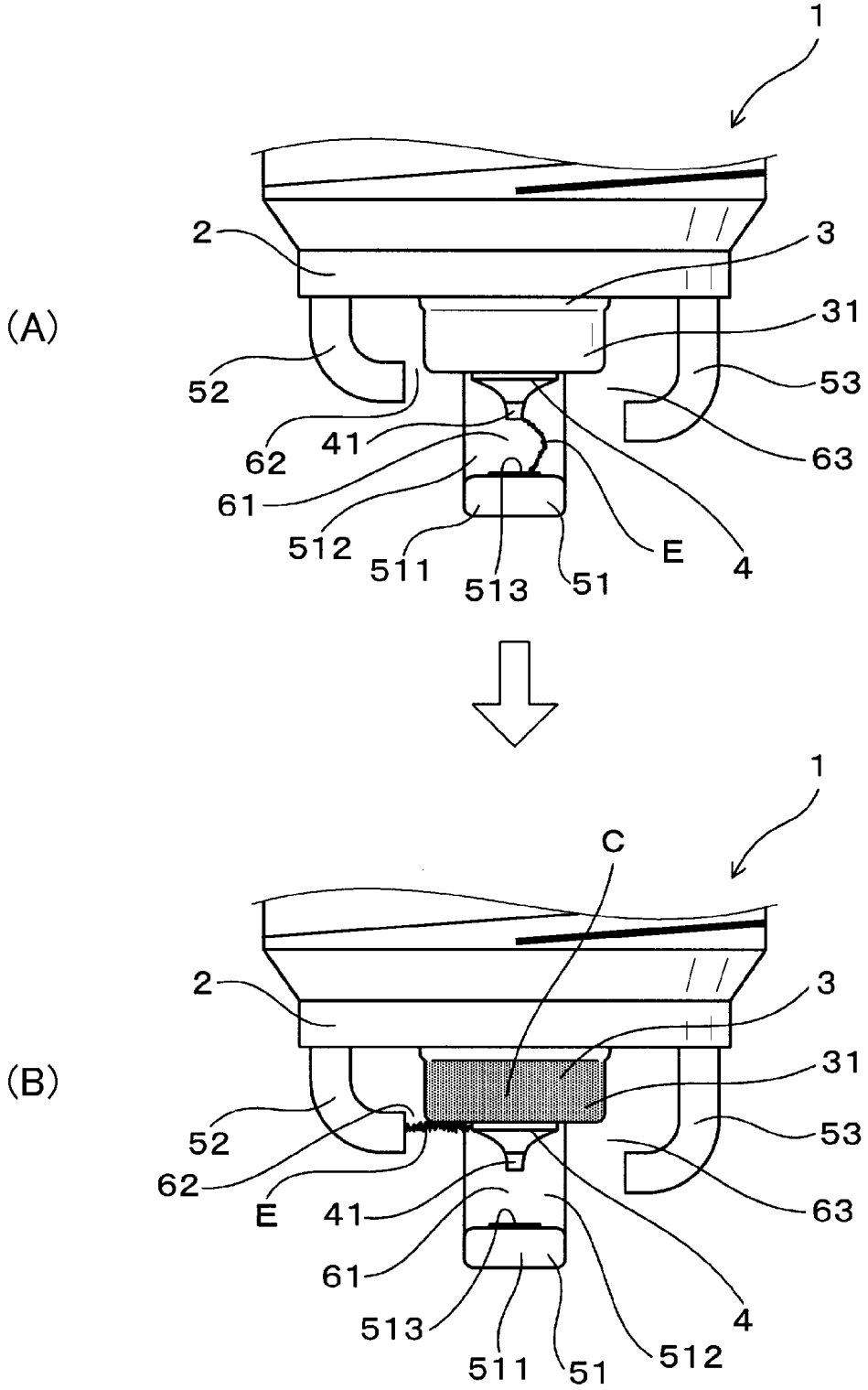
FIG. 9 is an explanatory view of the spark plug according to the first embodiment, specifically illustrating by (A) a state of discharge between a center electrode and a main ground electrode, and by (B) a state of discharge between the center electrode and a first sub ground electrode.
Figure 10:
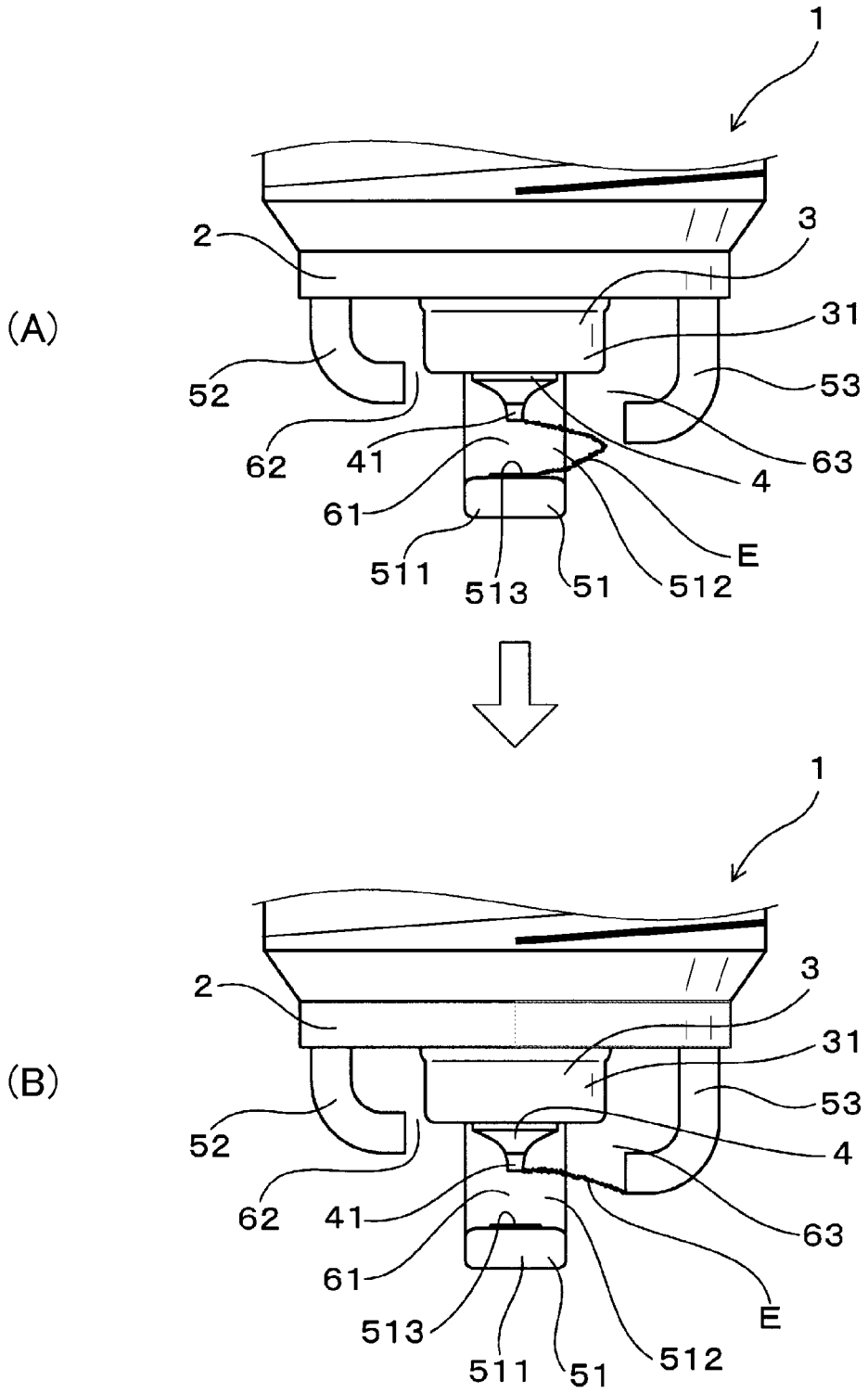
FIG. 10 is an explanatory view of the spark plug according to the first embodiment, specifically illustrating by (A) a state where a discharge spark is expanded between the center electrode and the main ground electrode, and by (B) a state of discharge of a discharge spark after being shifted to a second sub ground electrode.

Referring to FIGS. 9 and 10, hereinafter are described states of the discharge spark E when discharge is caused in the spark plug 1.

A predetermined voltage is applied across the center electrode 4 and the main ground electrode 51 to cause a discharge in the main gap 61. In the discharge, the discharge spark E is initially obtained, as shown in FIG. 9 by (A), in the main gap 61 between the center electrode 4 and the main ground electrode 51. Specifically, since the size Gm of the main gap 61 is the smallest and field intensity therein tends to be high, the initial discharge spark E is caused in the main gap 61.

Then, as shown in FIG. 9 by (B), carbon fouling may occur in the spark plug 1, or carbon fouling (in a range indicated by a reference C in the figure) may occur in the porcelain tip portion 31 of the spark plug 1, creating an electrically conductive state, and thus an appropriate discharge may no longer be obtained in relation to the main ground electrode 51. In such a case, discharge can be caused in the first sub gap 62 between the center electrode 4 and the first sub ground electrode 52. Thus, the carbon fouling portion can be burnt off and eliminated between the center electrode 4 and the first sub ground electrode 52 by the discharge spark E.

When the discharge spark E is obtained in the main gap 61, the discharge spark E drifts downstream by the flow F of the air-fuel mixture and expanded, as shown in FIG. 10 by (A), between an edge portion of the projection portion 41 of the center electrode 4 and an edge portion of the projection portion 513 of the main ground electrode 51. Normally, the air-fuel mixture is ignited by the discharge spark E during this period.

Then, in the spark plug 1 of the present embodiment, as shown in FIG. 10 by (B), when the discharge spark E is expanded to a downstream side between the edge portion of the projection portion 41 of the center electrode 4 and the edge portion of the projection portion 513 of the main ground electrode 51, an end of the discharge spark E is shifted to the second sub ground electrode 53. Therefore, the discharge spark E can be retained between the projection portion 41 of the center electrode 4 and the second sub ground electrode 53. Thus, the air-fuel mixture is ignited by this discharge spark E during this period.

Referring to FIGS. 8 to 10, advantageous effects of the present embodiment are described.

In the spark plug 1, the first sub ground electrode 52 and the second sub ground electrode 53 are arranged face to face sandwiching the opposing portion 511 of the main ground electrode 51 as viewed in the axial direction of the plug. Thus, as shown in FIG. 8, the spark plug 1 is mounted to the internal combustion engine 8 in a state where the first sub ground electrode 52 is located upstream in the flow F of the air-fuel mixture and the second sub ground electrode 53 is located downstream in the flow F, while the main ground electrode 51 is ensured not to be arranged upstream or downstream in the flow F.

Further, the length Hs1 of projection of the first sub ground electrode 52 from the tip of the housing 2 satisfies Hs1<Hc+Gm. Thus, in the above arrangement condition, the flow F directed to the main gap 61 is prevented from being blocked by the first sub ground electrode 52 located on an upstream side to thereby allow the flow F to enter the main gap 61. As a result, the air-fuel mixture is easily ignited in the main gap 61. At the same time, flame is easily grown and thus ignitability of the spark plug 1 is enhanced.

Further, as shown in FIG. 9 by (B), carbon fouling may occur in the spark plug 1, or carbon fouling may occur in the porcelain tip portion 31 of the spark plug 1, creating an electrically conductive state, and thus an appropriate discharge may no longer be obtained in relation to the main ground electrode 51. In such a case, discharge may be caused in the first sub gap 62. Further, the carbon is burnt off and eliminated by the discharge spark E of this instance. Thus, the portion from which the carbon has been eliminated is restored from the electrically conductive state to an insulated state. Accordingly, insulation properties of the porcelain tip portion 31 are retained. Thus, as shown in FIG. 9 by (A), an appropriate discharge can be caused between the center electrode 4 and the main ground electrode 5 to thereby obtain the discharge spark E. In this way, resistance to carbon fouling can be retained and hence the life of the spark plug 1 is enhanced.

Further, the spark plug 1 satisfies Gm<Gs1+Gg and Gm<Gs2+Gg. Thus, in the spark plug 1 prior to the occurrence of carbon fouling, the discharge spark E is prevented from being caused between the center electrode 4 and the first sub ground electrode 52 or between the center electrode 4 and the second sub ground electrode 53. Accordingly, the discharge spark E can be normally obtained in the main gap 61. As a result, the air-fuel mixture is easily ignited in the main gap 61, flame is easily grown, and ignitability of the spark plug 1 is enhanced.

The spark plug 1 satisfies Hs2≥Hs1 and Hc<Hs2, where Hs1 is the length of projection of the first sub ground electrode 52 from the tip of the housing 2, Hs2 is the length of projection of the second sub ground electrode 53 from the tip of the housing 2, and Hc is the length of projection of the center electrode 4 from the housing 2. Thus, in the above arrangement condition, when the discharge spark E caused in the main gap 61 is expanded to a large extent by the flow F, this discharge spark E is received, as shown in FIG. 10 by (B), by the second sub ground electrode 53. In other words, the discharge spark E is prevented from being expanded to a large extent and from being cut off, and the discharge spark E can be sustained between the center electrode 4 and the second sub ground electrode 53. Thus, repetition of discharge cutoff and re-discharge is suppressed. As a result, wear in the center electrode 4 and the main ground electrode 51 is minimized, and the life of the spark plug 1 is enhanced. Further, since the discharge spark E is sustained as mentioned above, an ignition opportunity for the flame (i.e., an opportunity for the ignition which leads to occurrence of the ignition) is well ensured and thus ignitability of the spark plug 1 is enhanced.

Further, the spark plug 1 satisfies Gs1<Gm. Accordingly, as shown in FIG. 9 by (B), when carbon fouling occurs in the spark plug 1, discharge is easily caused in the first sub gap 62. Thus, the discharge spark E is easily obtained between the first sub ground electrode 52 and the center electrode 4. Therefore, resistance to carbon fouling is easily ensured.

Further, the spark plug 1 satisfies Hs1<Hc. Accordingly, as shown in FIG. 8, the flow F directed to the main gap 61 is reliably prevented from being blocked by the first sub ground electrode 52 and hence the flow F can easily enter the main gap 61. Thus, the air-fuel mixture is ignited by the discharge spark E in the main gap 61 to obtain flame, and the flame can be easily grown. As a result, ignitability of the spark plug 1 is effectively enhanced.

Further, the spark plug satisfies Hs2<Hc+Gm. Accordingly, as shown in FIG. 8, the flow F that has entered the main gap 61 from the first sub gap 62 side can be easily passed to the second sub gap 63 side. Thus, the air-fuel mixture is easily ignited in the main gap 61, and the flame can be easily grown. As a result, ignitability of the spark plug 1 is effectively enhanced.

Further, the spark plug 1 satisfies Gs1<Gs2. Accordingly, when carbon fouling occurs in the spark plug 1 in the above arrangement condition, the spark plug 1 can reliably perform discharge in the first sub gap 62 in the sub ground electrode 52 on the upstream side. The discharge spark E obtained in this instance can burn off and eliminate the carbon fouling (hereinafter, this is referred to as carbon elimination function). On the other hand, the discharge spark E that has been caused in the main gap 61 can also be reliably shifted to the second sub ground electrode 53 on the downstream side. Accordingly, re-discharges that would be induced by the cutoff of the discharge spark E can be suppressed (hereinafter, this is referred to as re-discharge suppression function). Thus, the carbon elimination function and the re-discharge suppression function are realized by dividing these functions between the upstream side and the downstream side. As a result, the spark plug 1 is able to reliably retain resistance to carbon fouling, reliably suppress wear of the main ground electrode 51, and effectively enhance the life of the spark plug 1. In addition, an ignition opportunity is well ensured and accordingly ignitability of the spark plug 1 is effectively enhanced.

As described above, the present embodiment can provide a spark plug for an internal combustion engine and a mounting structure for the spark plug, with which ignitability and life of the spark plug are enhanced, while resistance to carbon fouling is retained.

EXPERIMENTAL EXAMPLE 1

Figure 11:
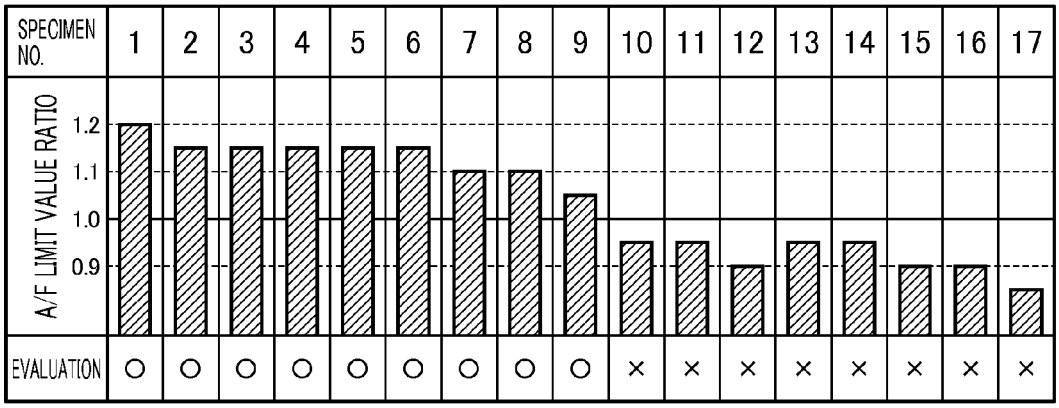
FIG. 11 is a diagram illustrating A/F limit value ratio, according to Experimental Example 1.

As shown in FIG. 11, in the present example, ignitability of a spark plug is researched by comparing A/F (Air-Fuel) limit values.

As a target of evaluation, the spark plug 1 shown in the first embodiment was dimensioned such that the base material (portion held inside the insulation porcelain 3) of the center electrode 4 had a maximum diameter of 2.3 mm, the electrode tip portion of the center electrode 4 had a diameter of 0.7 mm, the cross section of the opposing portion 511 of the main ground electrode 51 in the axial direction of the plug was substantially in a rectangular shape of 1.4 mm×2.6 mm, and the cross section of each of the opposing portions 521 and 531 of the first sub ground electrode 52 and the second sub ground electrode 53, respectively, in the axial direction of the plug was substantially in a rectangular shape of 1.2 mm×2.2 mm. Further, Hc was set to 4.0 mm, Gm was set to 0.8 mm, Gs1 and Gs2 were set to 0.5 mm, and Gg was set to 1.0 mm. Then, the spark plug 1 was set so as to satisfy Gm<Gs1+Gg and Gm<Gs2+Gg.

Then, as shown in Table 1 below, spark plugs as "Specimen 1" to "Specimen 17" were prepared, in which Hs1 was changed in a rage of 3.0 to 5.5 mm and Hs2 was changed in a range of 3.5 to 6.0 mm.

The following ignition test was conducted using these specimens.

TABLE 1

| Sample No. | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| Hs1 | 3 | 3 | 3 | 4 | 4 | 4 | 4.5 | 4.5 | 4.5 | 4.8 | 4.8 | 4.8 | 5 | 5 | 5 | 5.5 | 5.5 |
| Hs2 | 3.5 | 4 | 4.5 | 3.5 | 4 | 4.5 | 4 | 4.5 | 5 | 4 | 4.5 | 5 | 4.5 | 5 | 5.5 | 5.5 | 6 |
| Hs1 < Hc + Gm satisfied? | ○ | ○ | ○ | ○ | ○ | ○ | ○ | ○ | ○ | X | X | X | X | X | X | X | X |
| Hs1 ≤ Hs2 satisfied? | ○ | ○ | ○ | X | ○ | ○ | X | ○ | ○ | X | X | ○ | X | ○ | ○ | ○ | ○ |
| Hc < Hs2 satisfied? | X | X | ○ | X | X | ○ | X | ○ | ○ | X | ○ | ○ | ○ | ○ | ○ | ○ | ○ |

In conducting the ignition test, each of Specimens 1 to 17 was loaded on an in-line four-cylinder 1.8 L engine (hereinafter referred to as ignition test device) and the A/F value of the air-fuel mixture in the ignition test device was changed. In the ignition test of the present example, the spark plugs of Specimens 1 to 17 were evaluated as to whether they can achieve ignition in a thin air-fuel mixture, i.e. an air-fuel mixture having a high A/F value. In this evaluation method, an A/F limit value of 1.0 was rendered to correspond to the case of using the spark plug 9 (see FIG.

1) having neither the first sub ground electrode 52 nor the second sub ground electrode 53 as shown in the first embodiment. Each of the specimens was evaluated on the basis of the ratio of its A/F limit value to the above A/F limit value of 1.0 (hereinafter this is referred to as A/F limit value ratio). Specifically, in Specimens 1 to 17, when the A/F limit value ratio exceeded 1.0, ignitability was determined to have been enhanced and, when the A/F limit value ratio was less than 1.0, ignitability was determined to have been impaired. The A/F limit value, which was set using a combustion variable ratio, was rendered to be a critical A/F value that could suppress combustion to a level that could said to be normal combustion.

Further, each spark plug was loaded on the ignition test device in a state where the first sub ground electrode was located upstream in the gas flow and the second sub ground electrode was located downstream in the gas flow (see FIG. 6).

FIG. 11 shows the results of the ignition test. In the figure, the bar graphs show measured A/F limit value ratios of respective Specimens 1 to 17. The row below the bar graphs indicates evaluations on ignitability of the specimens. Specifically, the mark "O" shows the case where the A/F limit value ratio exceeded 1.0, and the mark "X" shows the case where the A/F limit value ratio was less than 1.0.

As will be understood from FIG. 11, Specimens 1 to 9 each exhibit an A/F limit value ratio exceeding 1.0 and thus have good ignitability (evaluation is "O"). On the other hand, Specimens 10 to 17 each exhibit an A/F limit value ratio of less than 1.0 and thus have lower ignitability (evaluation is "X"). As shown in Table 1, Specimens 1 to 9 satisfy Hs1<Hc+Gm, while Specimens 10 to 17 do not satisfy Hs1<Hc+Gm.

From the results set forth above, it will be understood that, when Hs1<Hc+Gm is satisfied, the A/F limit value is retained at a high level and ignitability of the spark plug is enhanced.

EXPERIMENTAL EXAMPLE 2

Figure 12:
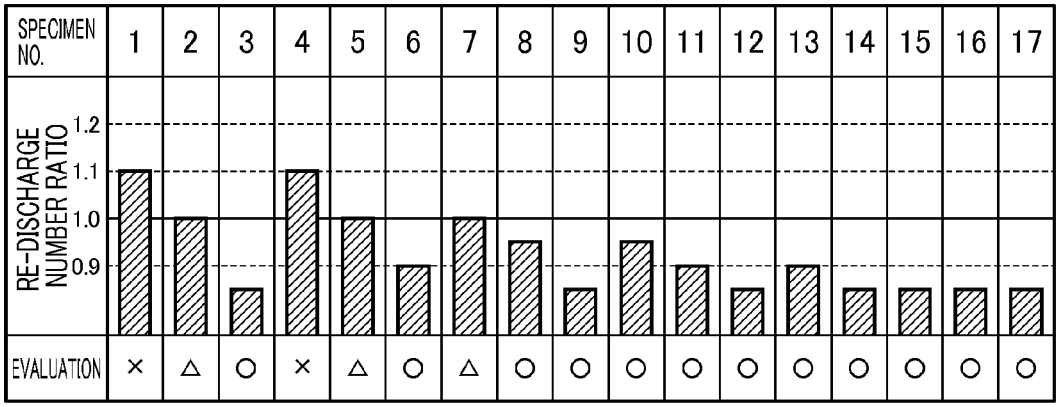
FIG. 12 is a diagram illustrating number of re-discharge ratio, according to Experimental Example 2.

As shown in FIG. 12, in the present example, durability of a spark plug was researched by comparing the numbers of re-discharges.

Figure 1:
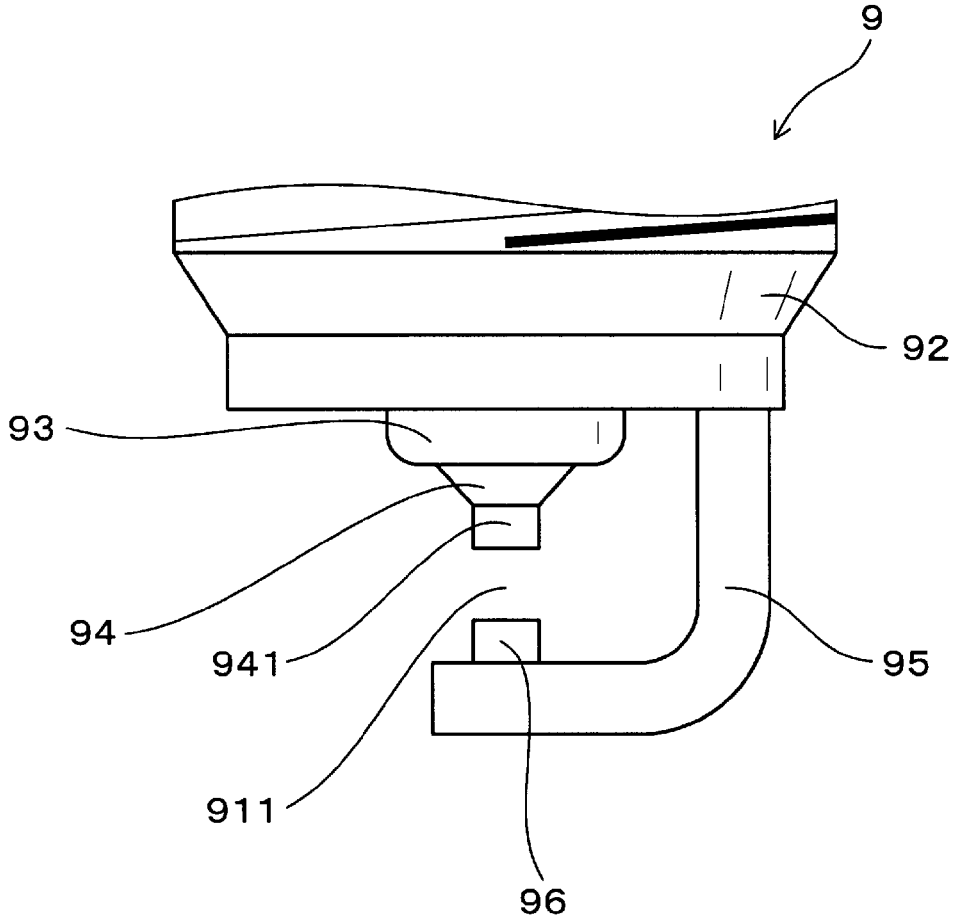
FIG.1 (RELATED ART)
FIG. 1 is an explanatory view illustrating a tip portion of a spark plug of the background art.
Figure 2:
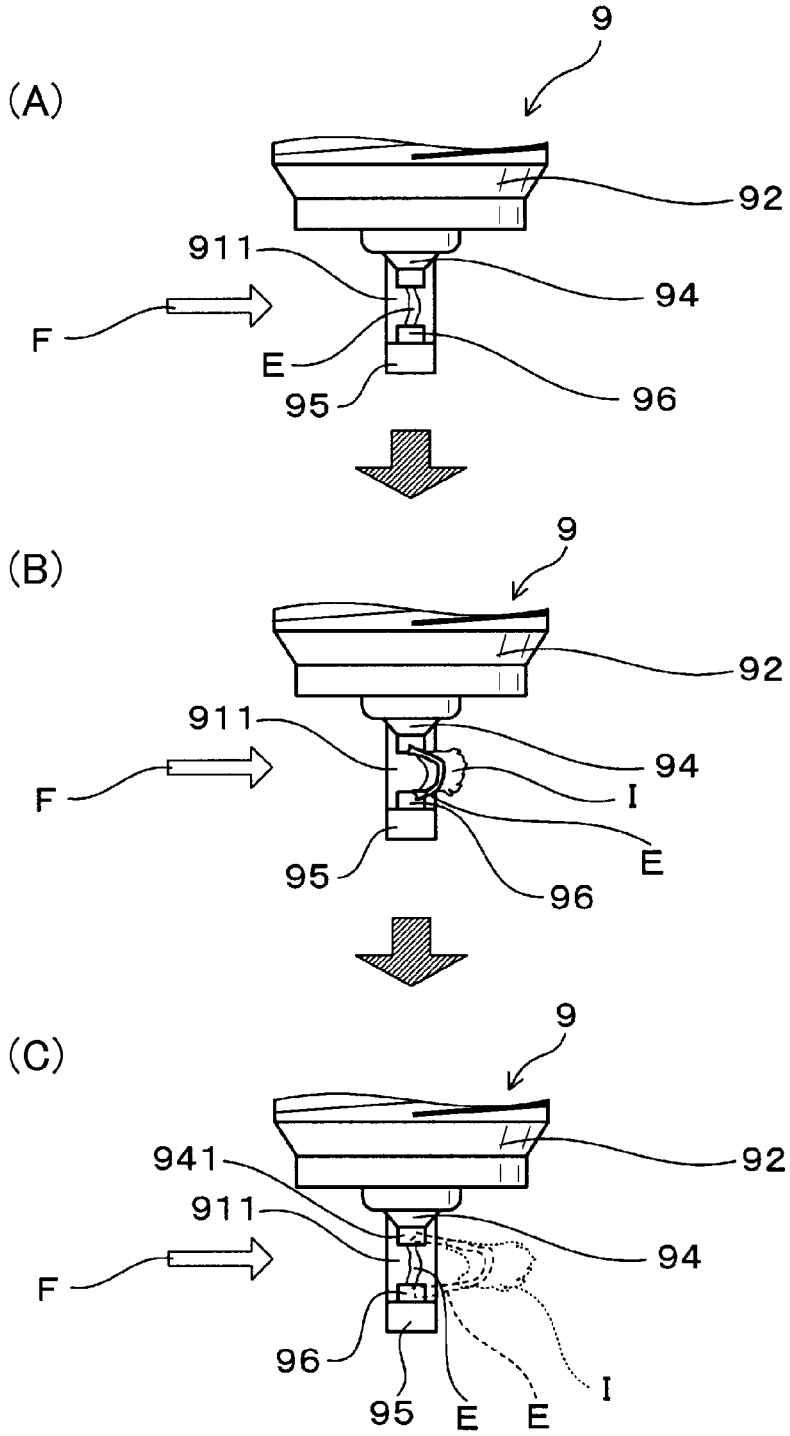
FIG.2 (RELATED ART)
FIG. 2 is an explanatory view illustrating the tip portion of the spark plug in the background art, specifically showing by (A) a state of discharge, by (B) a state where a discharge spark is blown and elongated by a gas flow, and by (C) a state of discharge cutoff.
Figure 3:
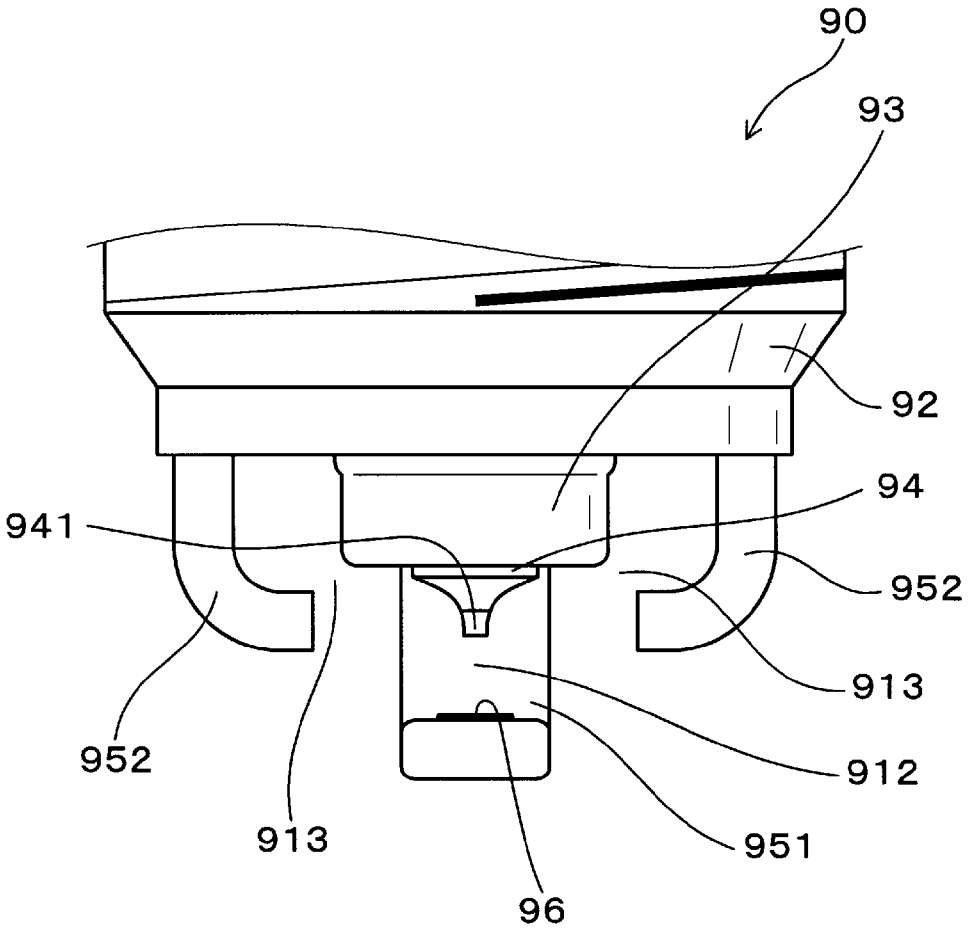
FIG.3 (RELATED ART)
FIG. 3 is an explanatory view illustrating a tip portion of a spark plug having a sub ground electrode that forms a sub gap, according to background art.
Figure 4:
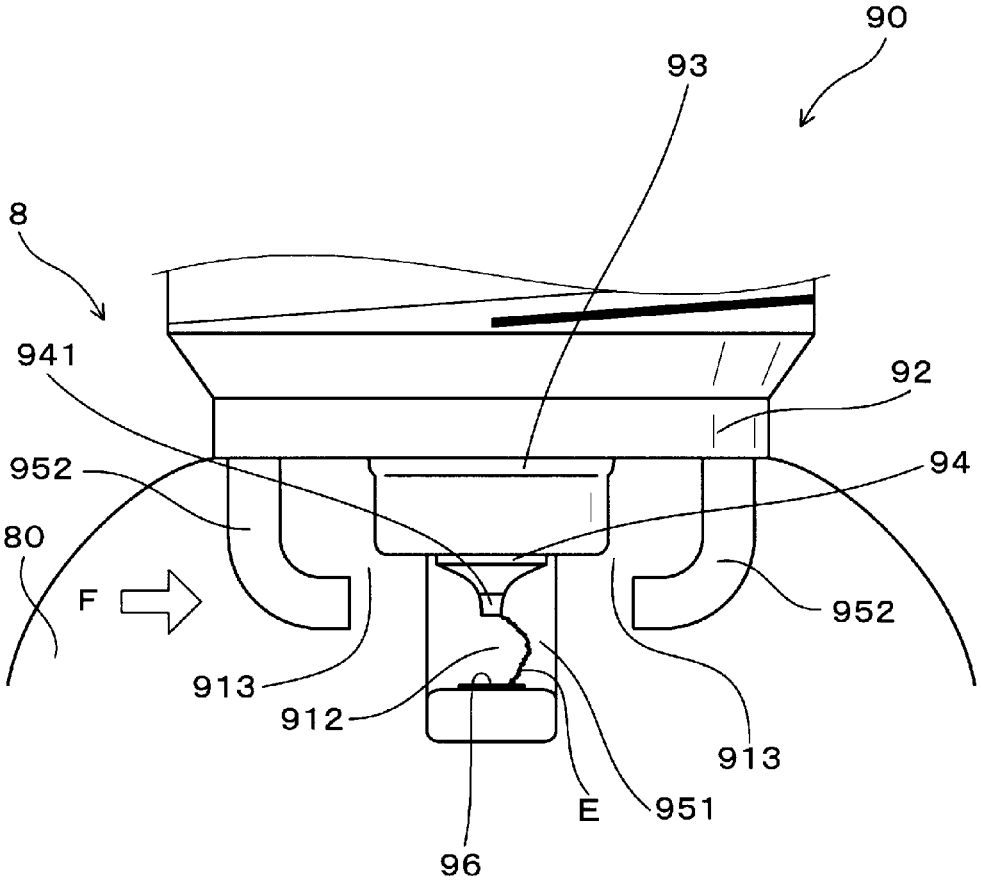
FIG.4 (RELATED ART)
FIG. 4 is an explanatory view illustrating a state where the spark plug having the sub ground electrode that forms a sub gap is mounted into a combustion chamber, according to background art.

Specifically, in the present example, the following endurance test was conducted to measure the number of times of re-discharges of each of the spark plugs of Specimens 1 to 17 shown in Experimental Example 1 (Table 1) and confirm whether the number of times of re-discharges is reduced compared to the number of times of re-discharges of the spark plug 9 (see FIG. 1) shown in Experimental Example 1.

The conditions of the targets of evaluation (Specimens 1 to 17) were similar to those in Experimental Example 1 described above. Further, three sample spark plugs were prepared for each of Specimens 1 to 17.

The following endurance test was conducted using these specimens.

In conducting the endurance test, the spark plugs of Specimens 1 to 17 were loaded on a test device resembling to the combustion chamber 80, creating a nitrogen atmosphere in the device at a pressure of 0.6 MPa.

Further, an air-fuel mixture was supplied to the device so as to form a flow at a flow speed of 30 m/sec in the vicinity of the tip portion of each spark plug, and a voltage was applied to each spark plug at a discharge cycle of 30 Hz. Ignition energy in this instance was 70 mJ.

Also, each spark plug was loaded on the test device in a state where the first sub ground electrode was located upstream in the flow and the second sub ground electrode was located downstream in the flow (see FIG. 6).

For each specimen, the waveform of discharge voltage of each of 10 spark discharges was measured for every lapse of 100 hours of endurance time, using a high-frequency probe, and the number of re-discharges was researched. The measurements were conducted by observing the waveform of electric current in every voltage application and counting the number of times for the electric current value to exceed a predetermined threshold.

The results shown in FIG. 12 are each based on an average of the numbers of re-discharges in the three samples of each specimen.

In the evaluation method in the endurance test, the number of times of re-discharges in the case of loading the spark plug 9 (see FIG. 1) on the test device was rendered to be 1.0 (hereinafter, this is referred to as re-discharge number ratio) to perform comparison and evaluation. The spark plug 9 was also used in Experimental Example 1. Specifically, in Specimens 1 to 17, when the re-discharge number ratio was less than 1.0, durability was determined to have been enhanced and, when the re-discharge number ratio exceeded 1.0, durability was determined to have been impaired.

FIG. 12 shows the results of the endurance test. In the figure, the bar graphs show the measured re-discharge number ratios for Specimens 1 to 17. Further, the row below the bar graphs indicates evaluation on durability for the specimens. Specifically, the mark "O" shows the case where the re-discharge number ratio was less than 1.0, the mark "Δ" shows the case where the re-discharge number ratio was 1.0, and the mark "X" shows the case where the re-discharge number ratio exceeded 1.0.

As will be understood from FIG. 12, among Specimens 1 to 9 that satisfied Hs1<Hc+Gm and exhibited enhancement in ignitability in Experimental Example 1, Specimens 3, 6, 8 and 9 show the re-discharge number ratio of less than 1.0 and show enhancement of durability (evaluation is "O"). On the other hand, Specimens 1 and 4 show the re-discharge number ratio exceeding 1.0 and show lowering of durability (evaluation is "X").

As shown in Table 1, Specimens 3, 6, 8 and 9 that exhibited the effect of enhancing durability satisfied Hs2≥Hs1 and Hc<Hs2. On the other hand, Specimens 1, 2 and 5 did not satisfy Hc<Hs2. Specimens 4 and 7 satisfied neither Hs2≥Hs1 nor Hc<Hs2.

From the foregoing results, it will be understood that life of the spark plug is enhanced when Hs2≥Hs1 and Hc<Hs2 are satisfied. Then, from the results of Experimental Examples 1 and 2, it will be understood that ignitability and life of the spark plug are enhanced when Hs1<Hc+Gm, Hs2≥Hs1 and Hc<Hs2 are all satisfied on the basis that Gm<Gs1+Gg and Gm<Gs2+Gg are satisfied.

As will be understood from FIG. 12, Specimens 10 to 17 also exhibit the re-discharge number ratio of less than 1.0 and thus can suppress the number of times of re-discharges. However, as shown in Experimental Example 1, Specimens 10 to 17 exhibit no enhancement in ignitability.

(Second Embodiment)

Figure 13:
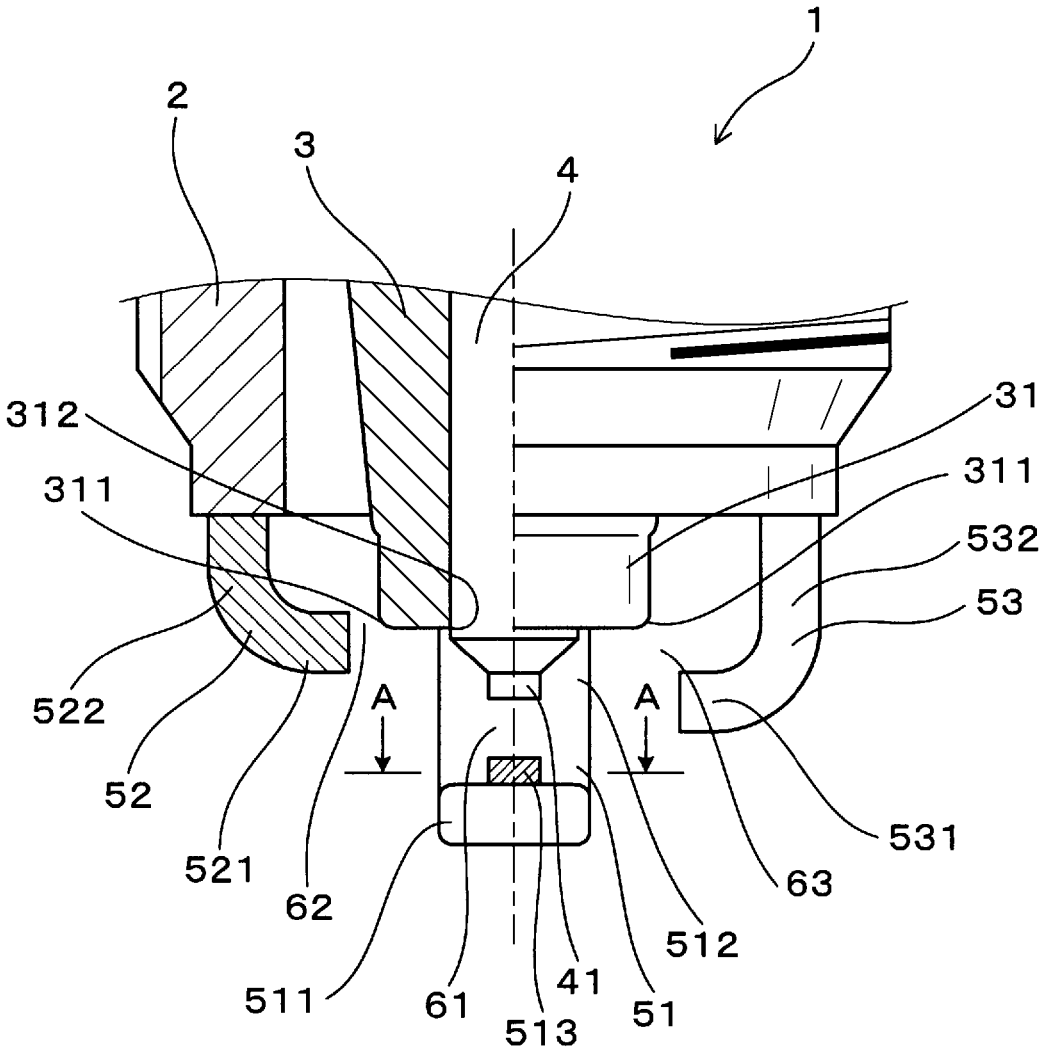
FIG. 13 is an explanatory view illustrating a partial cross section of a tip portion of a spark plug according to a second embodiment.
Figure 14:
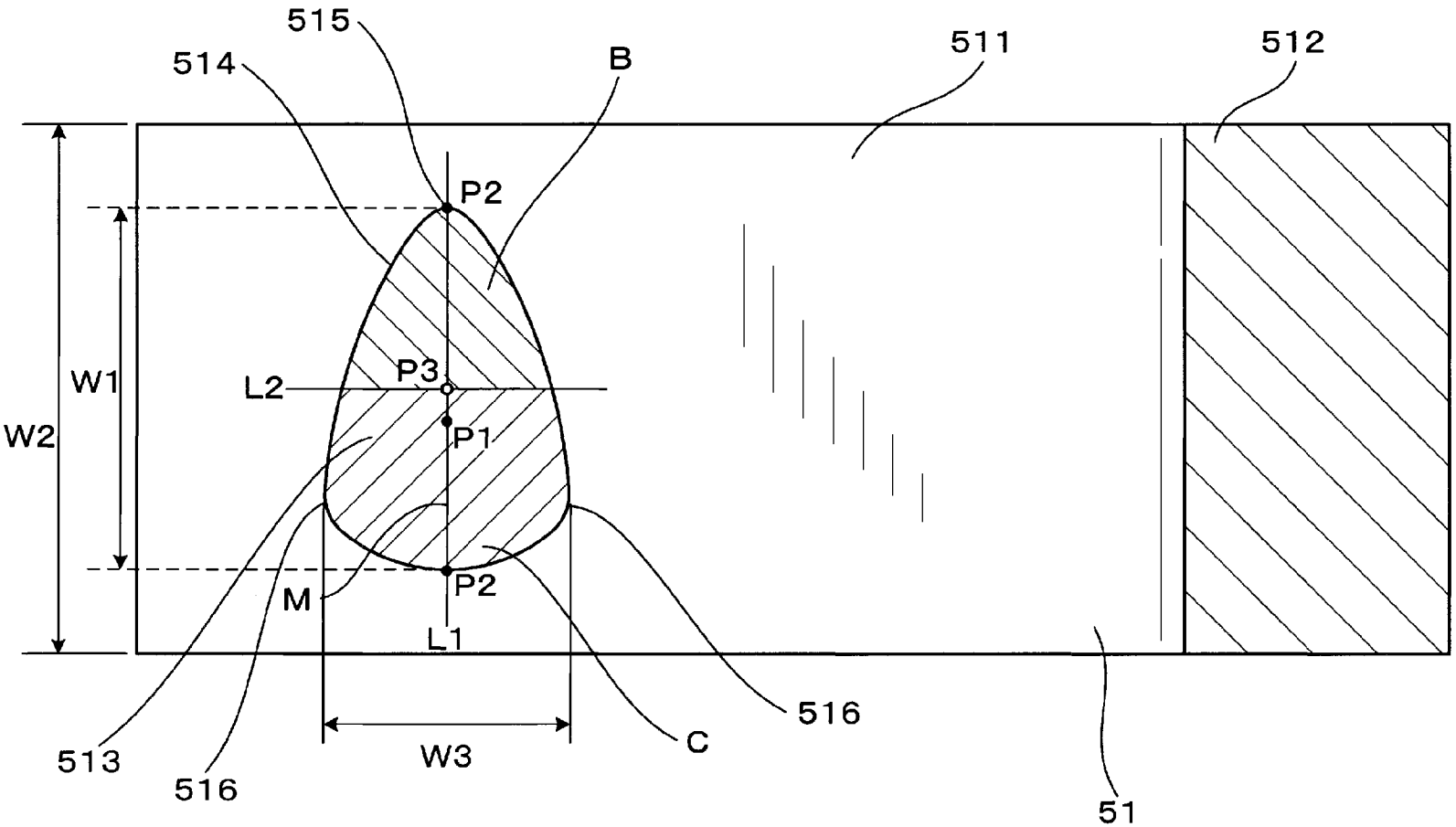
FIG. 14 is a cross-sectional view taken along a line A-A of FIG. 13.

As shown in FIGS. 13 and 14, in the present embodiment, the projection portion 513 in the opposing portion 511 of the main ground electrode 51 has a cross section in a specific shape as described below.

The projection portion 513 of the present embodiment has a cross section perpendicular to the axial direction of the plug, as shown in FIG. 14. The cross section has a contour 514 that includes a minimum curvature radius portion 515 having the smallest curvature radius, and is in a specific shape that satisfies the following requirement.

The requirement is defined as follows. Specifically, as shown in FIG. 14, first, a first straight line L1 is constructed to connect the minimum curvature radius portion 515 and a geometric centroid P1 in the cross section. Then, a first line segment M is supposed to connect between two intersections P2 at which the first straight line L1 intersects the contour 514 of the cross section. Then, a second straight line L2 is supposed to extend at right angle to the first line segment M, passing through a midpoint P3 of the first line segment M. Then, the cross section is divided by the second straight line L2 into a first region B that includes the minimum curvature radius portion 515 and a second region C that does not include the minimum curvature radius portion 515. In this case, the area of the second region C is larger than that of the first region B.

Further, as shown in FIG. 14, the projection portion 513 of the present embodiment is arranged such that the first straight line L1 will be perpendicular to an extending direction of the opposing portion 511 (broken line L5 indicated in FIG. 7) of the main ground electrode 51. The projection portion 513 is formed such that an overall length W1 thereof coinciding with the first straight line L1 will be smaller than a width W2 of the opposing portion 511, the width W2 being perpendicular to the extending direction of the opposing portion 511. The projection portion 513 is a pillar-shaped body having the cross section that satisfies the above specific shape. The projection portion 513 is arranged so as to be projected from a surface of the opposing portion 511, the surface being opposed to the center electrode 4 (see FIG. 13).

As shown in FIG. 14, the contour 514 of the cross section of the projection portion 513 is line symmetric with reference to the first straight line L1. The width of the contour 514 in the direction of the second straight line L2 gradually increases from the minimum curvature radius portion 515 of the first region B (intersection P2 on the first region B side) toward the second region C to thereby form maximum width portions 561 in the second region C. Also, in the cross section, the contour 514 is tucked starting from the maximum width portions 516 toward the intersection P2 on the second region C side. The maximum width portions 516 each have the smallest curvature radius in the contour 514 of the second region C.

The projection portion 513 of the present embodiment is fixed to the main ground electrode 51 such that the first region B will be located on the first sub ground electrode 52 side and the second region C will be located on the second sub ground electrode 53 side.

The rest other than the above is similar to the first embodiment.

In the present embodiment, the projection portion 513 has the cross section perpendicular to the axial direction of the plug and is in the specific shape. Specifically, as shown in FIG. 14, the projection portion 513 is formed such that the second region C in the cross section will have an area larger than the area of the first region B. Further, the projection portion 513 is fixed to the main ground electrode 51 such that the first region B is located on the first sub ground electrode 52 side and the second region C is located on the second sub ground electrode 53 side. Similar to the first embodiment, the spark plug 1 is mounted to the combustion chamber 80 of the internal combustion engine 8 so that the first sub ground electrode 52 is located upstream in the flow F and the second sub ground electrode 53 is located downstream in the flow F. Thus, the first region B is located upstream in the flow F and the second region C is located downstream in the flow F. Therefore, when re-discharge is repeatedly caused at the edge portion downstream in the projection portion 513, wear in the projection portion 6 due to the re-discharges can be suppressed according to the larger area. Thus, disproportionate wear of the projection portion 513 is minimized and wear resistance is enhanced. As a result, the life of the spark plug 1 is effectively enhanced.

Further, with the above arrangement, the minimum curvature radius portion 515 of the first region B is located on the upstream side. Electric field is most likely to be concentrated in the vicinity of the minimum curvature radius portion 515 and thus the minimum curvature radius portion 515 is likely to serve as a start point of discharge. Therefore, by arranging the minimum curvature radius portion 515 on the upstream side, the discharge spark E can be initially obtained upstream in the projection portion 513. Then, time is guaranteed before the discharge spark E drifts downstream and blown off by the air-fuel mixture. Thus, an ignition opportunity for flare is well ensured. As a result, ignitability of the spark plug 1 is effectively enhanced.

The configuration described above is realized by allowing the projection portion 513 to have the cross section in the specific shape. This also contributes to suppressing quenching action without having to particularly increase the diameter of the projection portion 513. As a result, ignitability of the spark plug 1 is effectively prevented from being impaired.

Other than the above, advantageous effects similar to those of the first embodiment are obtained.

In the present embodiment, the projection portion 41 substantially in a pillar shape is arranged in the center electrode 4, and the projection portion 513 in the specific shape is arranged in the main ground electrode 51. However, this shall not impose a limitation. In other words, the projection portion 41 may also be in the specific shape (see FIG. 14) similar to the projection portion 513 of the present embodiment.

(Third Embodiment)

Figure 15:
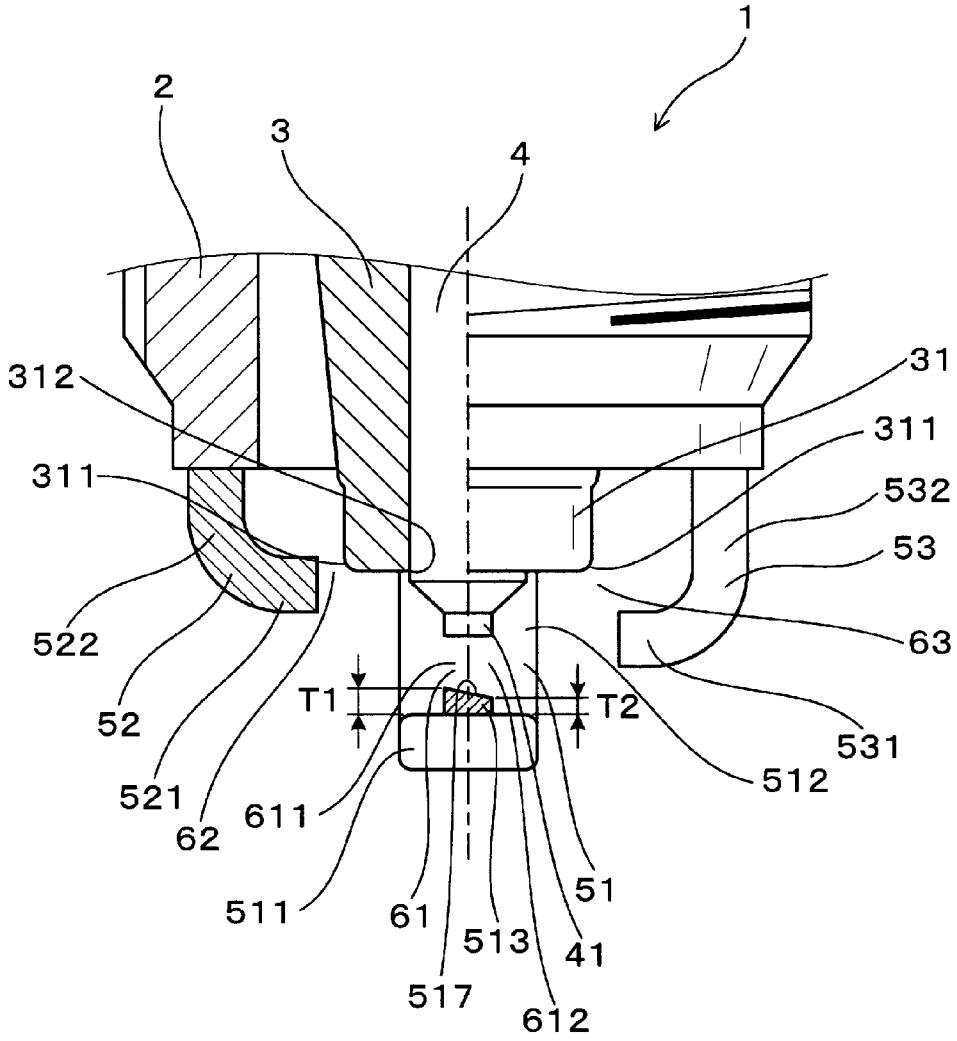
FIG. 15 is an explanatory view illustrating a tip portion of a spark plug according to a third embodiment.

As shown in FIGS. 14 and 15, in the present embodiment, the projection portion 513 in the opposing portion 511 of the main ground electrode 51 is formed into a specific shape shown in FIG. 15. Also, in the present embodiment, a narrow gap 611 and a wide gap 612 are formed in the main gap 61. The terms "narrow" and "wide" with regard to the gaps express a mutual magnitude relationship concerning the size of the gap in the axial direction of the plug.

The projection portion 513 of the present embodiment is substantially a pillar-shaped body and has a cross section perpendicular to the axial direction of the plug, the cross section satisfying the specific shape shown in the second embodiment (see FIG. 14).

On one end side in the axial direction of the plug, the projection portion 513 has a maximum height T1 in the axial direction of the plug. On the other end side, the projection portion 513 has a minimum height T2 in the axial direction of the plug. Specifically, as shown in FIG. 15, the projection portion 513 has an opposing surface 517 that confronts the main gap 61 and inclines with respect to a plane perpendicular to the axial direction of the plug. The center electrode 4 is provided with the substantially pillar-shaped projection portion 41 whose height in the axial direction of the plug is constant.

As shown in the figure, the main gap 61 is configured to be gradually enlarged from the narrow gap 611 on one end side toward the wide gap 612 on the other end side in one direction perpendicular to the axial direction of the plug.

In the present embodiment, the main gap 61 is configured to be gradually enlarged along a direction perpendicular to the extending direction of the opposing portion 511 (broken line L5 indicated in FIG. 7) of the main ground electrode 51.

Further, the projection portion 513 is fixed to the main ground electrode 51 such that the narrow gap 611 is located on the first sub ground electrode 52 side and the wide gap 612 is located on the second sub ground electrode 53 side.

The rest other than the above is similar to the second embodiment.

In the present embodiment, as shown in FIG. 15, the projection portion 513 has the opposing surface 517 that confronts the main gap 61 and inclines with respect to a plane perpendicular to the axial direction of the plug. Further, the main gap 61 is configured to be gradually enlarged from one end side toward the other end side, so that the narrow gap 611 is formed on one end side and the wide gap 612 is formed on the other end side in one direction perpendicular to the axial direction of the plug. Also, the projection portion 513 is fixed to the main ground electrode 51 such that the narrow gap 611 is located on the first sub ground electrode 52 side and the wide gap 612 is located on the second sub ground electrode 53 side. Similar to the first embodiment, the spark plug 1 is mounted to the combustion chamber 80 of the internal combustion engine 8 such that the first sub ground electrode 52 is located upstream in the flow F and the second sub ground electrode 53 is located downstream in the flow F. Thus, the narrow gap 611 is located upstream in the flow F and the wide gap 612 is located downstream in the flow F. In this way, in the spark plug 1, discharge voltage is suppressed, and wear resistance and ignitability are enhanced.

This mechanism is described below.

With the above arrangement, the narrow gap 611 is located on the upstream side. Electric field is most likely to be concentrated in the vicinity of the narrow gap 611 and thus one end side in the projection portion 513 is likely to serve as a start point of discharge. As a result, discharge voltage can be suppressed as well. Thus, by locating upstream the one end side forming the narrow gap 611, the initial discharge spark E can be obtained upstream in the projection portion 513. This guarantees time before the discharge spark E drifts downstream and blown off by the air-fuel mixture. Thus, an ignition opportunity for flame is well ensured, which leads to reducing the number of times of re-discharge to easily suppress the acceleration of wear in the projection portion 513. As a result, wear resistance and ignitability of the spark plug 1 are enhanced.

Further, with the above arrangement, the wide gap 612 is located downstream in the gas flow in the projection portion 513. Therefore, when the discharge spark E drifts downstream in the projection portion 513 as mentioned above, the discharge spark E will have a large discharge length between the center electrode 4 and the main ground electrode 51. Thus, discharge length of the discharge spark E is easily ensured to be large and an ignition opportunity of the air-fuel mixture is well ensured. As a result, ignitability of the spark plug 1 is enhanced.

The above configuration is realized by inclining the opposing surface 517 of the projection portion 513 with respect to a plane perpendicular to the axial direction of the plug, the opposing surface 517 confronting the main gap 61, and by gradually enlarging the main gap 61 from the narrow gap 611 on one end side toward the wide gap 612 on the other end side in one direction perpendicular to the axial direction of the plug. Accordingly, wear resistance is enhanced without having to particularly increasing the diameter of the projection portion. Thus, while quenching action is suppressed, the life of the spark plug 1 is enhanced.

Other than the above, advantageous effects similar to those of the second embodiment are obtained.

In the projection portion 41 as well, the opposing surface thereof confronting the main gap 61 may be inclined with respect to a plane perpendicular to the axial direction of the plug, similar to the projection portion 513 of the present embodiment.

DESCRIPTION OF SYMBOLS

1 Spark plug
2 Housing
3 Insulation porcelain
311 Outer peripheral edge portion
312 Inner peripheral edge portion
4 Center electrode
51 Main ground electrode
52 First sub ground electrode
53 Second sub ground electrode
61 Main gap
62 First sub gap
63 Second sub gap

What is claimed is:

1. A spark plug for an internal combustion engine comprising: a cylindrical housing; a cylindrical insulation porcelain held inside the housing, with a porcelain tip portion projecting from the housing; a center electrode held inside the insulation porcelain, with a tip portion being projected; a main ground electrode connected to the housing and having an opposing portion that faces the center electrode in an axial direction of the spark plug to form a main gap in relation to the center electrode; a first sub ground electrode connected to the housing and forming a first sub gap in relation to an outer peripheral edge portion in the porcelain tip portion; and a second sub ground electrode connected to the housing and forming a second sub gap in relation to the outer peripheral edge portion in the porcelain tip portion, wherein the first sub ground electrode and the second sub ground electrode are arranged face to face sandwiching the opposing portion of the main ground electrode in the axial direction of the spark plug; and the following requirements are satisfied:

$$Hs1<Hc+Gm,$$

$$Hs1<Hc,$$

$$Gm<Gs1+Gg,$$

$$Gm<Gs2+Gg,$$

$$Hs2>Hs1,$$

$$Gs1<Gs2, \text{ and}$$

$$Hc<Hs2$$

where Hc is a length of projection of the center electrode from the housing, Gm is a size of the main gap, Hs1 is a length of projection of the first sub ground electrode from a tip of the housing, Hs2 is a length of projection of the second sub ground electrode from the tip of the housing, Gs1 is a length of the first sub gap in a radial direction of the spark plug, Gs2 is a length of the second sub gap in a radial direction of the spark plug and Gg is a distance between the outer peripheral edge portion and an inner peripheral edge portion of the porcelain tip portion in a radial direction of the spark plug.

2. The spark plug for an internal combustion engine according to claim 1, wherein a requirement of Gs1<Gm is satisfied.

3. The spark plug for an internal combustion engine according to claim 2, wherein a requirement of Hs2<Hc+Gm is satisfied.

4. The spark plug for an internal combustion engine according to claim 1, wherein a requirement of Hs2<Hc+Gm is satisfied.

5. A mounting structure for mounting the spark plug mounted to an internal combustion engine, the spark plug comprising: a cylindrical housing; a cylindrical insulation porcelain held inside the housing, with a porcelain tip portion being projecting from the housing; a center electrode held inside the insulation porcelain, with a tip portion being projected; a main ground electrode connected to the housing and having an opposing portion that faces the center electrode in n axial direction of the spark plug to form a main gap in relation to the center electrode; a first sub ground electrode connected to the housing and forming a first sub gap in relation to an outer peripheral edge portion in the porcelain tip portion; and a second sub ground electrode connected to the housing and forming a second sub gap in relation to the outer peripheral edge portion in the porcelain tip portion, wherein the first sub ground electrode and the second sub ground electrode are arranged face to face sandwiching the opposing portion of the main ground electrode as viewed in the axial direction of the spark plug; and the following requirements are satisfied:

$$Hs1<Hc+Gm,$$

$$Hs1<Hc,$$

$$Gm<Gs1+Gg$$

$$Gm<Gs2+Gg,$$

$$Hs2>Hs1,$$

$$Gs1<Gs2, \text{ and}$$

$$Hc<Hs2$$

where Hc is a length of projection of the center electrode from the housing, Gm is a size of the main gap, Hs1 is a length of projection of the first sub ground electrode from a tip of the housing, Hs2 is a length of projection of the second sub ground electrode from the tip of the housing, Gs1 is a length of the first sub gap in a radial direction of the spark plug, Gs2 is a length of the second sub gap in a radial direction of the spark plug and Gg is a distance between the outer peripheral edge portion and an inner peripheral edge portion of the porcelain tip portion in a radial direction of the spark plug, and wherein the mounting structure is structured such that the first sub ground electrode arranged in a combustion chamber of the engine is located upstream of the second sub ground electrode with respect to a flow of an air-fuel mixture supplied to the combustion chamber.

* * * * *